US011160405B2

(12) United States Patent
Jones et al.

(10) Patent No.: US 11,160,405 B2
(45) Date of Patent: Nov. 2, 2021

(54) HOLDER DEVICE AND SYSTEM FOR ATTACHMENT TO MOBILITY EQUIPMENT

(71) Applicant: FFORA, Inc., Brooklyn, NY (US)

(72) Inventors: Lucy Jones, Brooklyn, NY (US); Joonas Kyoestilae, Brooklyn, NY (US)

(73) Assignee: FFORA, INC., Brooklyn, NY (US)

( * ) Notice: Subject to any disclaimer, the term of this patent is extended or adjusted under 35 U.S.C. 154(b) by 241 days.

(21) Appl. No.: 16/416,575

(22) Filed: May 20, 2019

(65) Prior Publication Data

US 2019/0350394 A1 Nov. 21, 2019

Related U.S. Application Data

(63) Continuation-in-part of application No. 29/677,941, filed on Jan. 24, 2019, now Pat. No. Des. 899,235.

(60) Provisional application No. 62/673,529, filed on May 18, 2018.

(51) Int. Cl.

| | |
|---|---|
| ***A47G 1/17*** | (2006.01) |
| ***A47G 23/02*** | (2006.01) |
| ***A61G 5/10*** | (2006.01) |

(52) U.S. Cl.

CPC ..... *A47G 23/0216* (2013.01); *A61G 5/10* (2013.01); *B65D 2313/04* (2013.01)

(58) Field of Classification Search

CPC ..... F16M 13/02; A47G 23/0216; A61G 5/10; B60R 11/0241; B60R 2011/001; B65D 2313/04

USPC .... 248/683, 206.5, 309.4, 311.2, 318, 205.1, 248/225.11; 220/703, 737, 230

See application file for complete search history.

(56) References Cited

U.S. PATENT DOCUMENTS

| | | | | |
|---|---|---|---|---|
| 3,556,341 A | | 1/1971 | Rains | |
| 5,895,018 A | * | 4/1999 | Rielo | A47K 10/12 248/206.5 |
| 6,076,790 A | * | 6/2000 | Richter | B60R 11/00 248/206.5 |
| 8,001,671 B2 | * | 8/2011 | Mitchell | A47G 23/0225 29/525.01 |
| 8,662,362 B1 | * | 3/2014 | Bastian | H04B 1/3888 224/218 |

(Continued)

OTHER PUBLICATIONS

Fidlock, "Bottle Twist," Online: https://enduro-mtb.com/, YouTube video, Dec. 9, 2016.

(Continued)

*Primary Examiner* — Todd M Epps
(74) *Attorney, Agent, or Firm* — Myers Wolin, LLC

(57) ABSTRACT

A holder device is provided for attachment to a wheelchair or other mobility equipment. The device has a surface that is at least partially bounded, with the bounded portion forming a slot. The device has a first holder magnet at the surface adjacent a terminus of the slot and a second holder magnet at the surface spaced apart from the first magnet. Also provided is a system for fixing an accessory to a wheelchair or other mobility equipment. The system has a holder device, such as that described above, and a sliding member for interfacing with the holder device. The sliding member has a sliding surface for mating with the holder surface, a first sliding magnet at the sliding surface of the sliding member, and a second sliding magnet spaced apart from the first sliding magnet.

14 Claims, 14 Drawing Sheets

(56) References Cited

U.S. PATENT DOCUMENTS

| | | | | |
|---|---|---|---|---|
| 8,936,222 | B1 * | 1/2015 | Bastian | H04B 1/3877 248/206.5 |
| 9,616,821 | B2 * | 4/2017 | Elharar | F16M 13/022 |
| 9,616,822 | B1 * | 4/2017 | Hamilton | B60R 11/02 |
| 9,758,080 | B2 * | 9/2017 | Goldman | B60N 3/101 |
| 10,913,593 | B2 * | 2/2021 | Adjeleian | B65D 81/3879 |
| 2006/0201956 | A1 | 9/2006 | Romo | |
| 2009/0032657 | A1 * | 2/2009 | Huang | A47G 23/0225 248/207 |
| 2011/0024470 | A1 * | 2/2011 | Hajarian | B60R 11/0258 224/276 |
| 2015/0144754 | A1 * | 5/2015 | Elharar | F16M 13/02 248/230.8 |
| 2021/0179321 | A1 * | 6/2021 | Karbakhsh | B65D 25/22 |

OTHER PUBLICATIONS

Rixen Kaul, "Bottle Klick," Online: https://KlickFix.com, Jan. 17, 2012.

* cited by examiner

HOLDER DEVICE AND SYSTEM FOR ATTACHMENT TO MOBILITY EQUIPMENT

CROSS REFERENCE TO RELATED APPLICATIONS

This invention claims the benefit of U.S. Provisional Patent Application No. 62/673,529, filed May 18, 2018, and is a Continuation in Part of U.S. Design patent application No. 29/677,941, filed Jan. 24, 2019, the contents of each of which are incorporated by reference herein.

FIELD OF THE INVENTION

This invention relates generally to holder devices for use with a wheelchair or other mobility equipment, and more particularly to a slotted holder device for attachment to a wheelchair.

BACKGROUND

Wheelchair users often require a location to store objects while using their wheelchairs. For example, users may need both hands to move their chair, and therefore need an easily accessible location for storing anything they might otherwise be holding, such as a beverage in a cup. However, available holders are limited in terms of the types of objects they can hold or retain or ease of access. Further, holders designed to hold one type of item, such as a cup, may be unusable for holding an alternative type of object.

SUMMARY

A holder device is provided for attachment to a wheelchair or other mobility equipment. The device has a surface that is at least partially bounded, with the bounded portion forming a slot. The device has a first holder magnet at the surface adjacent a terminus of the slot and a second holder magnet at the surface spaced apart from the first magnet. In some embodiments, the surface is only partially bounded, and the first holder magnet is in the slot and the second holder magnet is outside the slot. In other embodiments both the first and second holder magnets are within the bounded portion of the holder device surface.

Also provided is a system for fixing an accessory to a wheelchair or other mobility equipment. The system has a holder device, such as that described above, and a sliding member for interfacing with the holder device. The sliding member has a sliding surface for mating with the holder surface, a first sliding magnet at the sliding surface of the sliding member, and a second sliding magnet spaced apart from the first sliding magnet. A distance between the first sliding magnet and the second sliding magnet is substantially similar to a distance between the first holder magnet and the second holder magnet.

Typically, when the sliding member is fully inserted into the slot, the first holder magnet is opposite the first sliding magnet, and the second holder magnet is opposite the second sliding magnet.

In embodiments where the holder surface is only partially bounded, and where the first holder magnet is in the slot and the second holder magnet is outside the slot, the system has two assembled configurations. In a first assembled configuration, the first sliding magnet is opposite the second holding magnet, and in the second assembled configuration, the sliding member is fully inserted into the slot, and the first holder magnet is opposite the first sliding magnet and the second holder magnet is opposite the second sliding magnet.

In such embodiments, the first assembled configuration initially retains the sliding member when inserting the sliding member into the holder and finally retains the sliding member when removing the sliding member from the holder. Accordingly, the first assembled configuration is a transitional configuration between the second assembled configuration and fully detaching the sliding member from the holding member.

In such embodiments, when in the second assembled configuration, the first holder magnet retains the sliding member at the end of its travel within the slot, and the first and second holder magnets combine to securely retain the sliding member in the slot. The boundary of the slot prevents rotation of the sliding member relative to the holder device.

The system may further comprise an accessory holder fixed to the sliding member. For example, the accessory holder may be a cup holder. In further embodiments, an actual accessory may be fixed to the sliding member. For example, a purse or other bag may be fixed to the sliding member.

DETAILED DESCRIPTION OF THE PREFERRED EMBODIMENTS

Figure 1A:
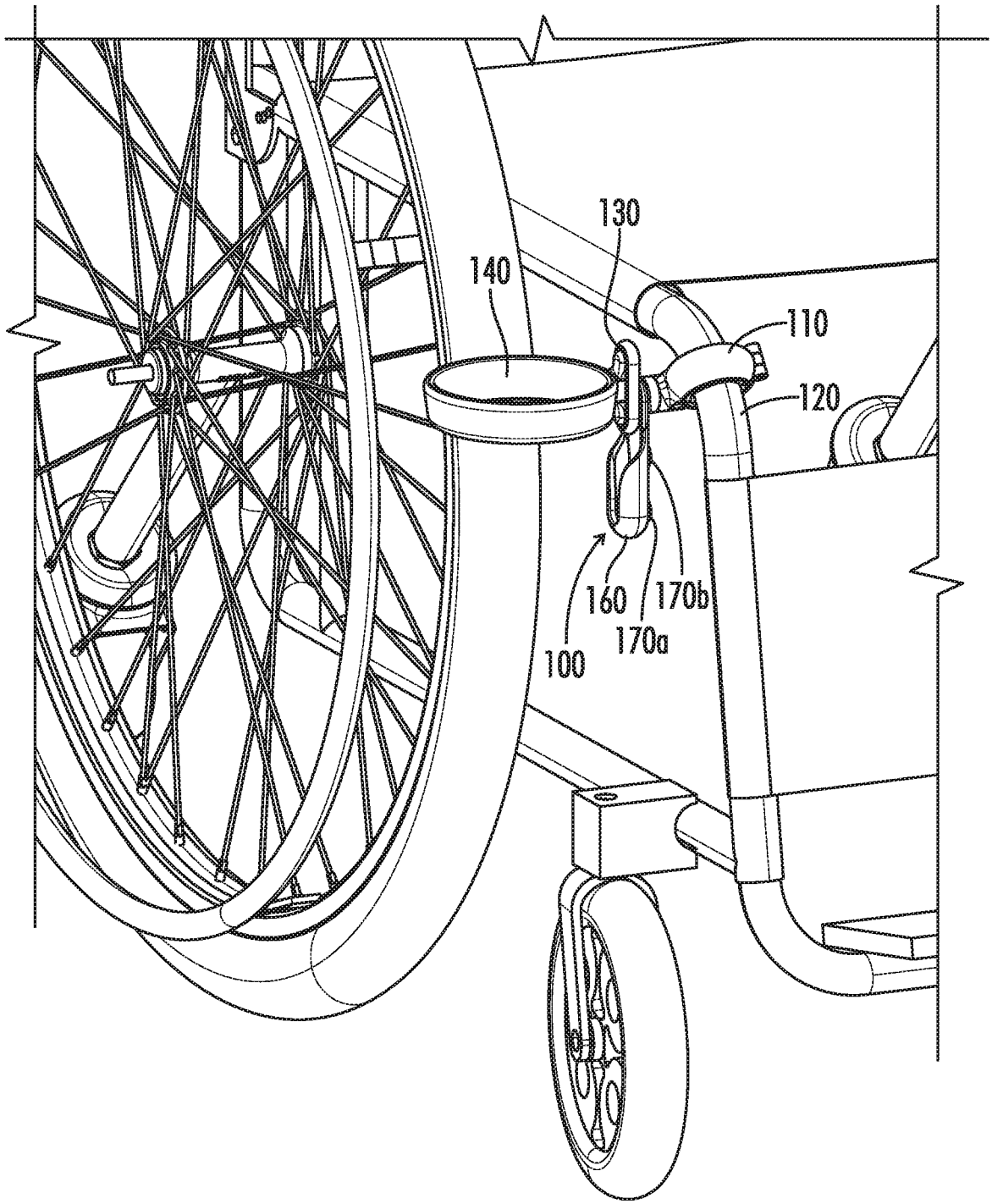
FIGS. 1A-B show a perspective view of a first embodiment of a holder device and system in two assembled configurations applied to a wheelchair in accordance with this disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1B:
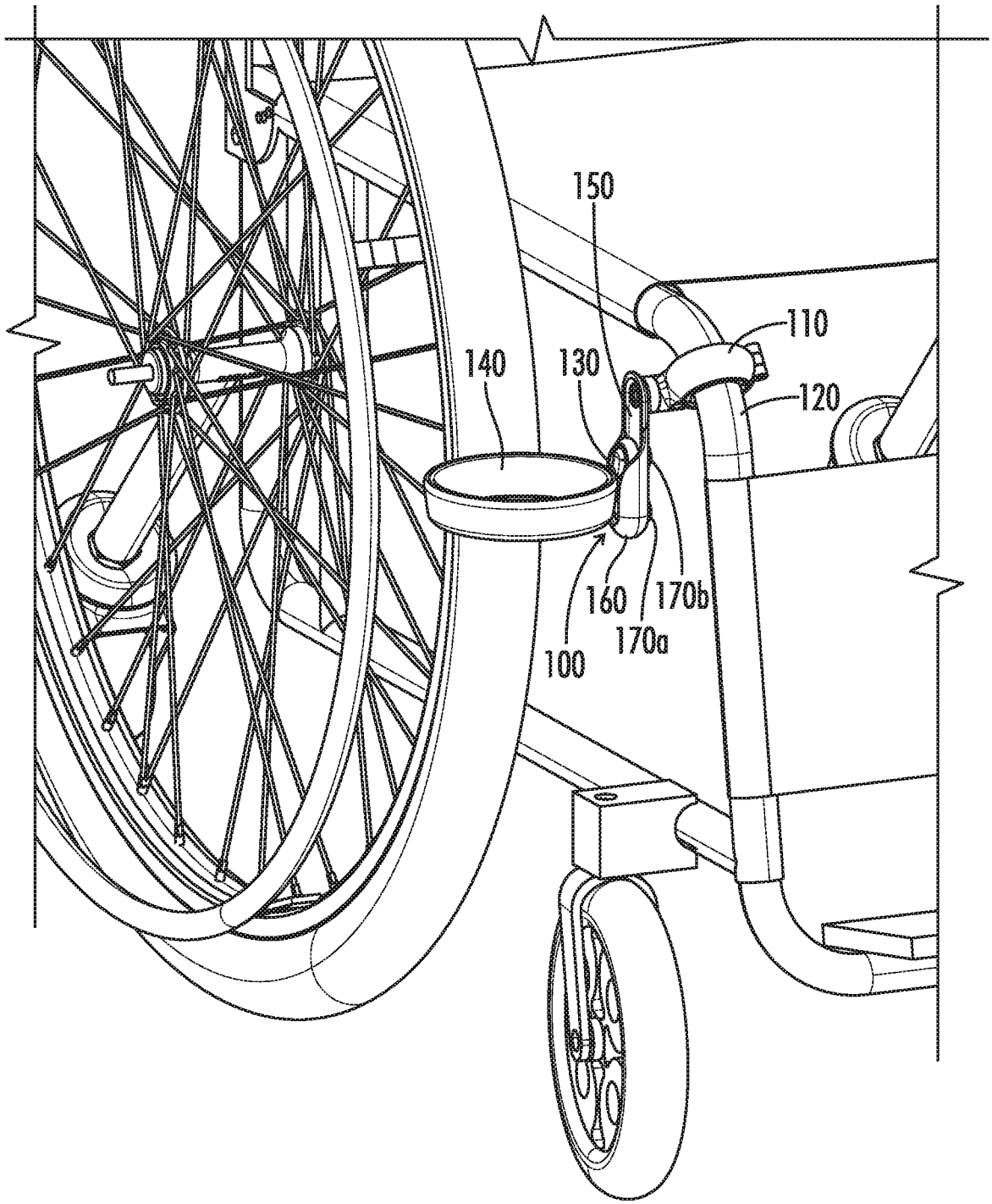

FIGS. 1A-B show a perspective view of a first embodiment of a holder device 110 and system 100 in two assembled configurations applied to a wheelchair 120 in accordance with this disclosure. As shown, the system 100 is a system for fixing an accessory to mobility equipment, such as a wheelchair 120. While the embodiments are typically described with respect to a wheelchair, it will be understood that the same embodiments, or variations thereof, may also be applied to other mobility devices, such as various types of scooters, strollers, walkers, bicycles and the like.

The system 100 described typically comprises the holder device 110 for attachment to the wheelchair 120 and a sliding member 130. The sliding member 130 typically retains the accessory or contains a holder for a specific type of accessory. In the embodiment shown, the sliding member 130 includes a cup holder 140, and the cup holder, and/or a cup contained within the cup holder can be easily accessed by a user of the wheelchair.

As shown, the holder device 110 has a surface 150, and the surface is at least partially bounded by sidewalls 160. For a portion of the surface 150 bounded, the combination of the sidewalls 160 and the surface form a slot. As shown, the sidewalls 130 may arch such that the slot forms a pocket which is more easily seen in the figures associated with the second embodiment.

Further, the holder device 110 typically has at least two magnets 170*a, b*. This includes a first magnet 170*a* at the surface of the holder device adjacent a terminus of the slot. It will be understood that the term at the surface is intended to mean either on the surface, flush with the surface, or behind the surface, such that the effect of the magnet may be felt by a magnetic object placed against the surface. The magnets 170 also includes a second magnet 170*b* at the surface spaced apart from the first magnet 170*a*. As shown, the two magnets 170 are typically spaced apart from each other along the axis of the slot, and the second magnet may be located outside the slot. Alternatively, as shown in the second embodiment, the second magnet 170*b* may be within the length of the slot.

Additional features, as well as the functionality of the system 100 is similar to that of the system 200 shown in the second embodiment, and is discussed in more detail with respect to FIGS. 2A-11.

FIGS. 2A-D show a perspective view of a second embodiment of a holder device 210 and system 200 in four configurations in accordance with this disclosure. As discussed above with respect to the first embodiment, the system 200 is a system for fixing an accessory to a mobility device, such as a wheelchair. As shown, the system 200 typically comprises the holder device 210 in combination with a sliding member 230. FIGS. 2A-D show the system 200 in four configurations.

Figure 2A:
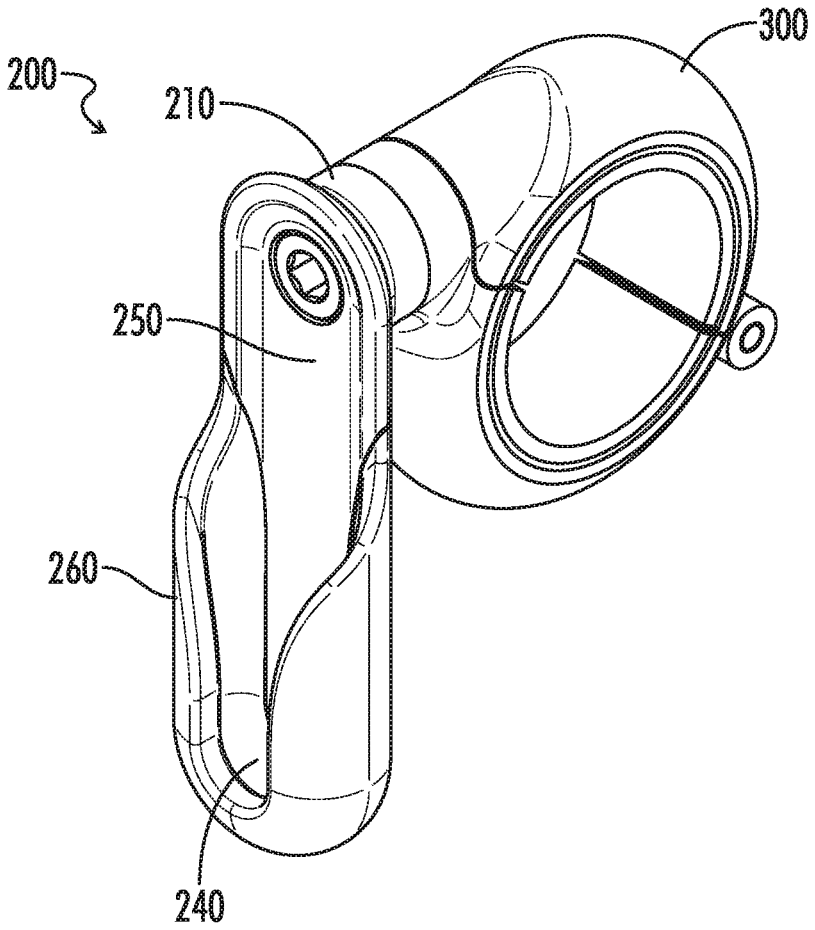
FIGS. 2A-D show a perspective view of a second embodiment of a holder device and system in four configurations in accordance with this disclosure.
Figure 2B:
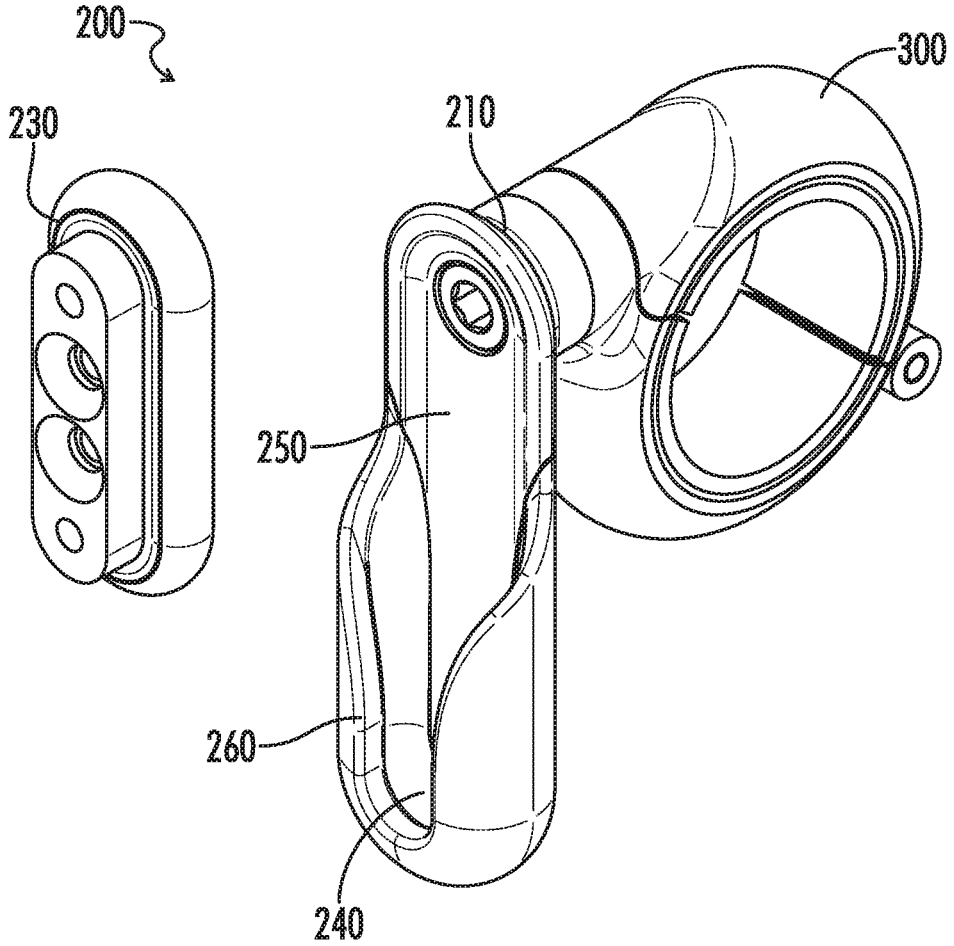
Figure 2C:
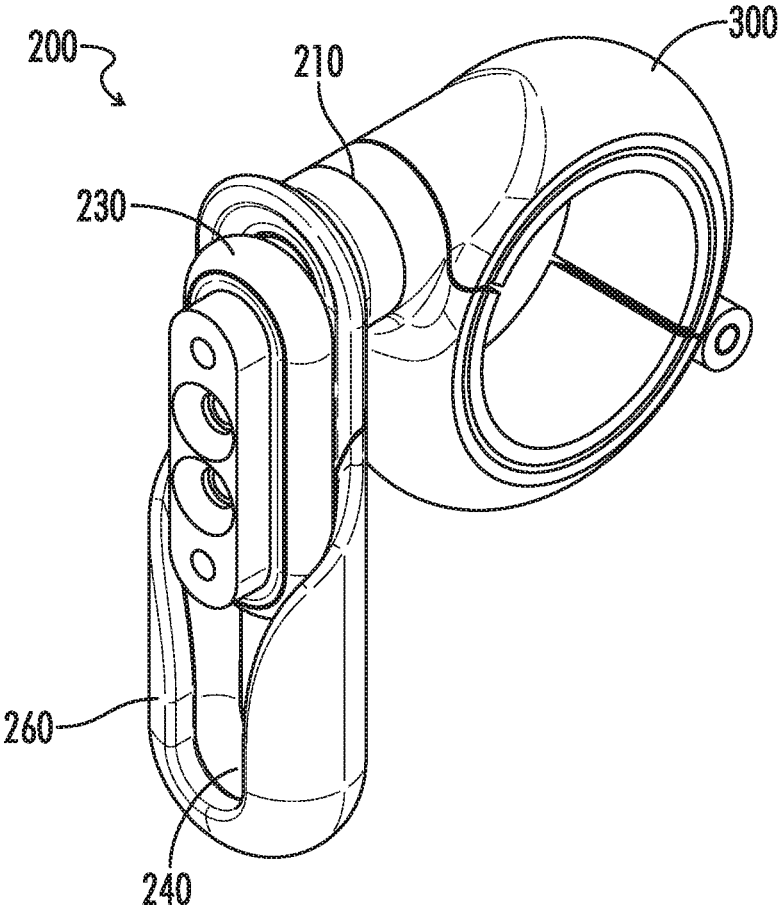
Figure 2D:
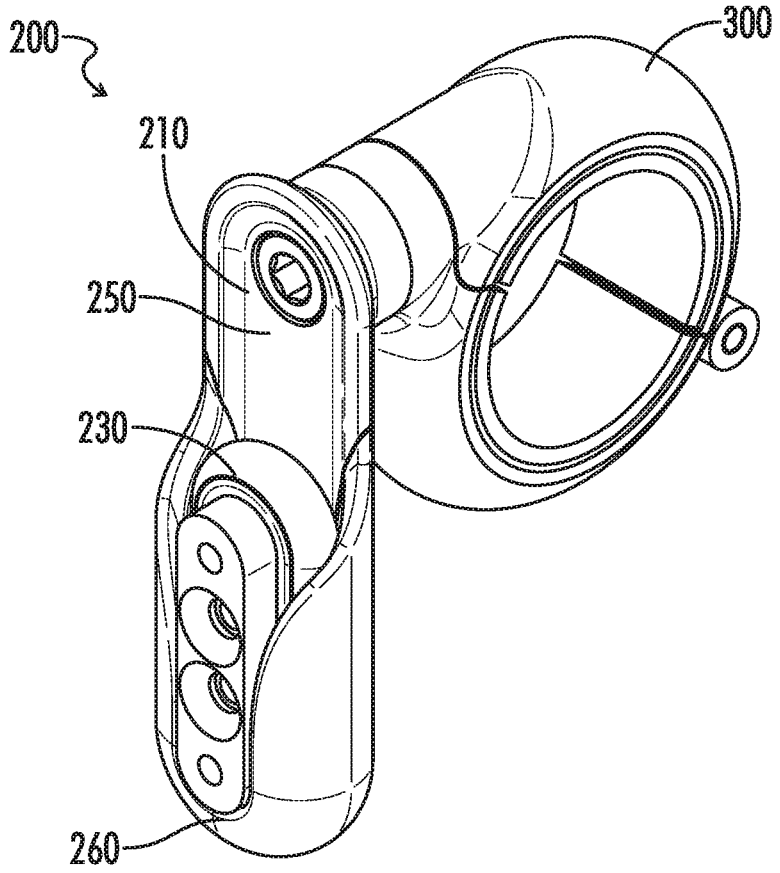

FIG. 2A shows only the holder device 210 as it is typically installed on a wheelchair. FIG. 2B shows the sliding member 230 as part of the system but kept separate from the holder device 210. FIG. 2C shows a first assembled configuration, with the sliding member 230 being placed against a surface 250 of the holder device 210, and FIG. 2D shows the sliding member in a slot of the holder device.

Figure 3A:
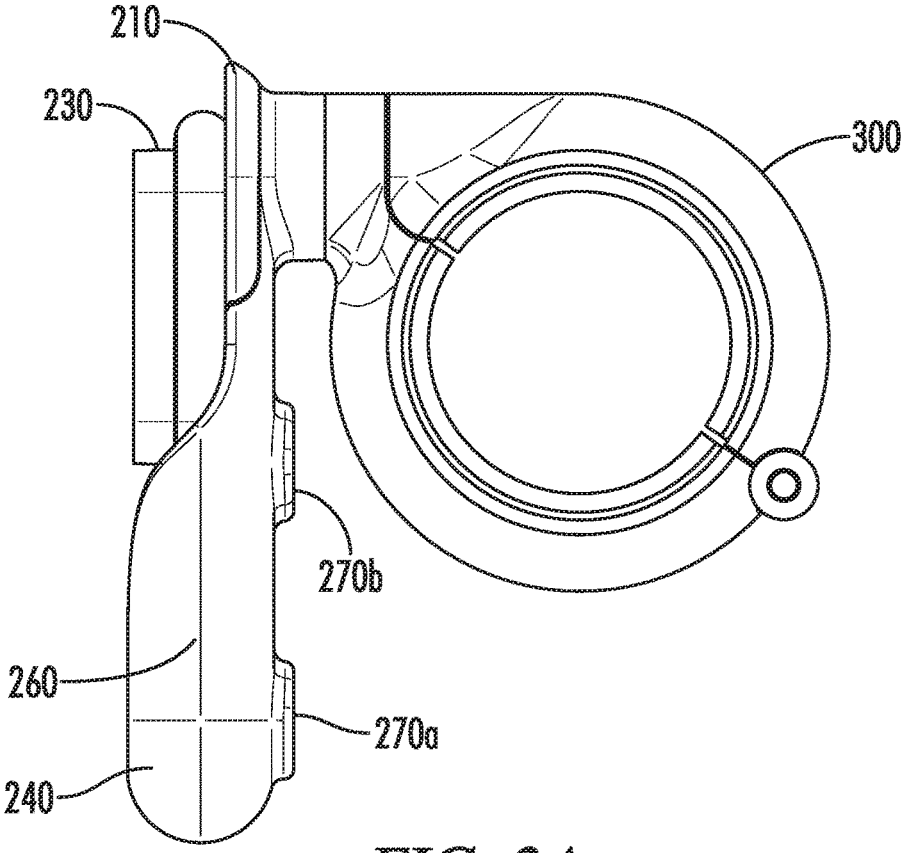
FIGS. 3A-B show a side view of the embodiment of the holder device and system of FIGS. 2A-D in two assembled configurations in accordance with this disclosure.
Figure 3B:
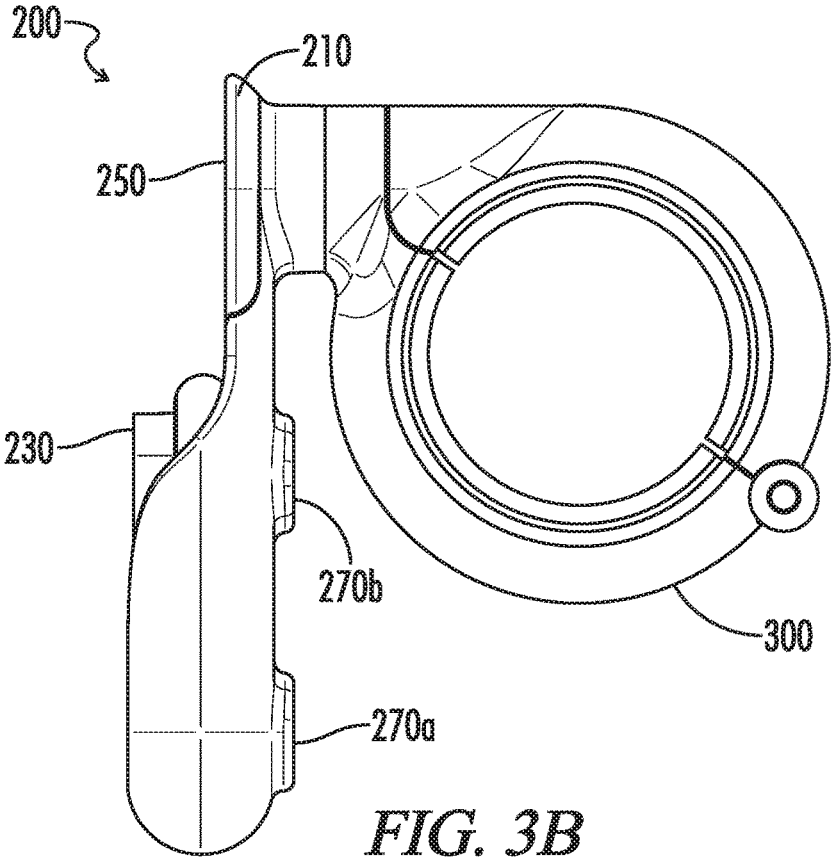
Figure 4A:
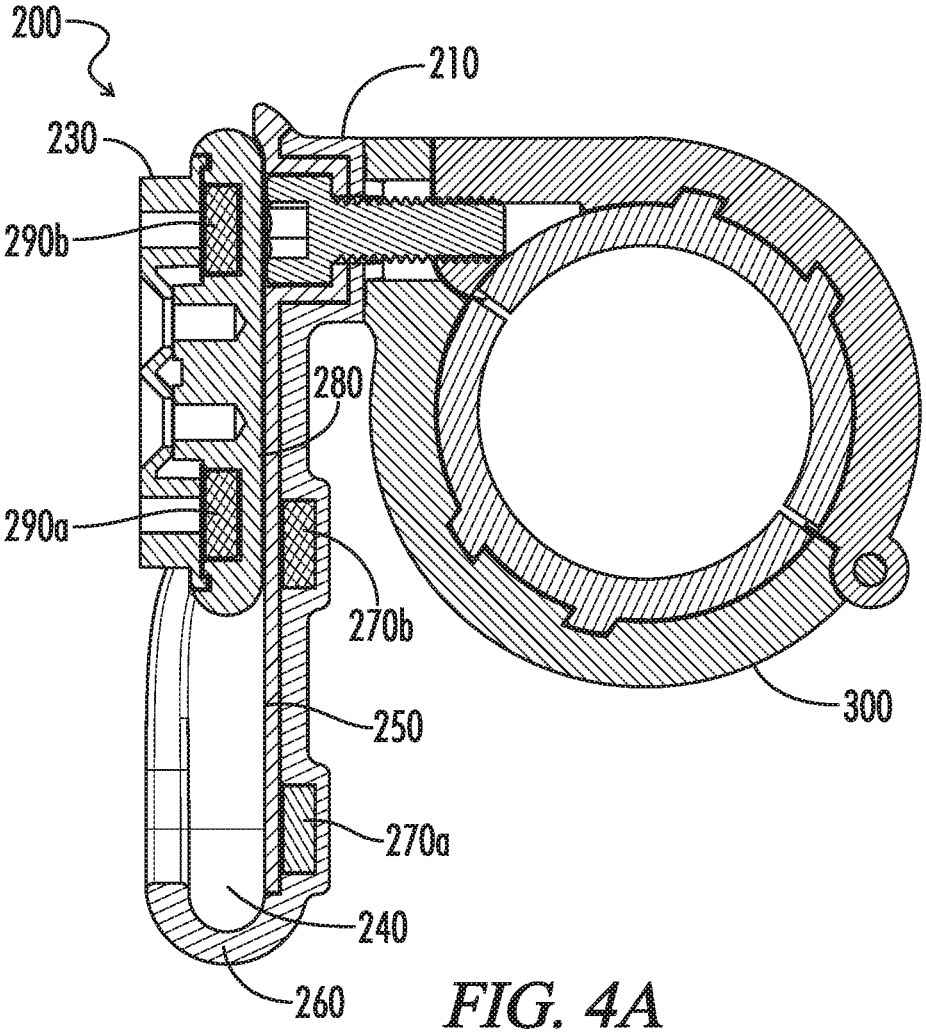
FIGS. 4A-B show a sectioned view of the embodiment of the holder device and system of FIGS. 2A-D in the same two assembled configurations as FIGS. 3A-B in accordance with this disclosure.
Figure 4B:
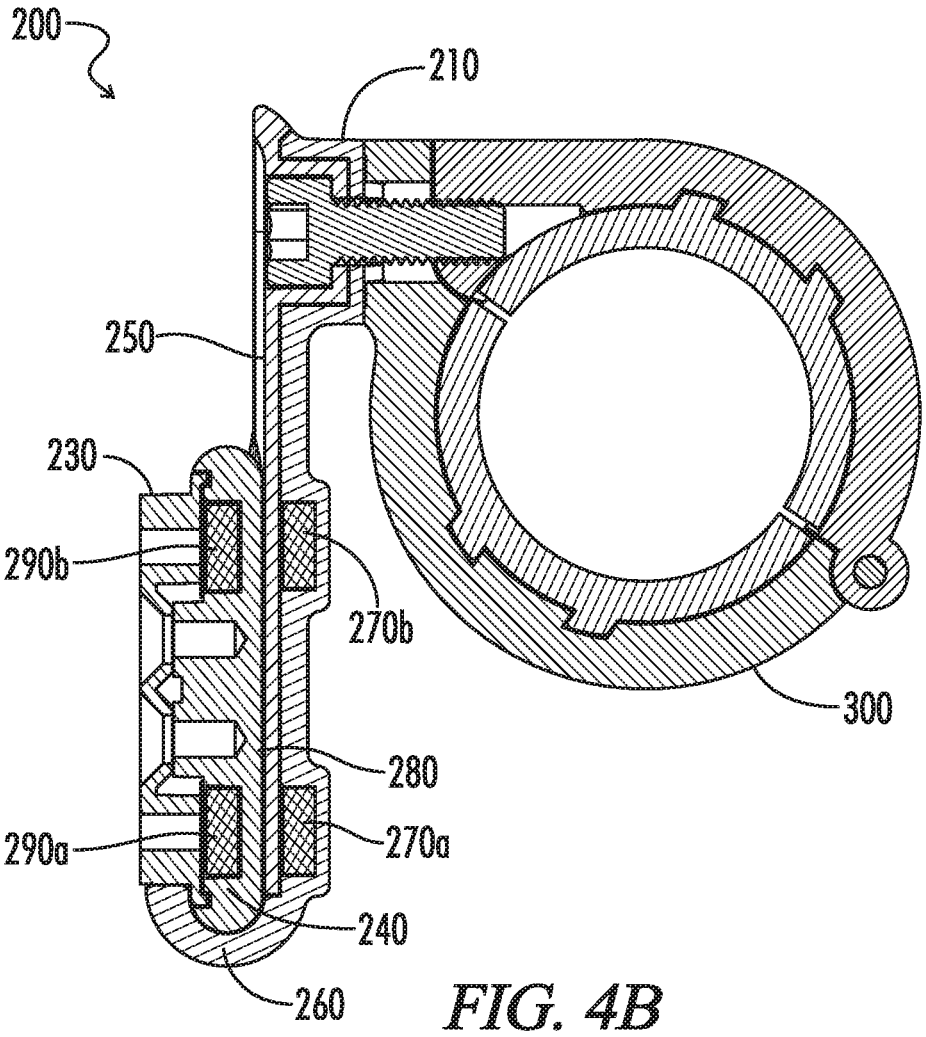

FIGS. 3A-B show a side view of the first and second assembled configurations of the holder device 210 and system 200, and FIGS. 4A-B show sectioned views of FIGS. 3A-B respectively.

Accordingly, the holder device 210 has a surface 250, and the surface is at least partially bounded by sidewalls 260. For a portion of the surface 250 bounded, the combination of the sidewalls 260 and the surface form a slot. As shown, the sidewalls 230 may arch such that the slot forms a pocket which is more easily seen in the figures associated with the second embodiment. Further, the sidewalls 230 may continue around a terminus 240 of the slot.

Further, the holder device 210 typically has at least two magnets 270 (visible in FIGS. 3A-4B). This includes a first magnet 270*a* at the surface of the holder device adjacent the terminus 240 of the slot. It will be understood that the term "at the surface" is intended to mean either on the surface, flush with the surface, or behind the surface, such that the effect of the magnet may be felt by a magnetic object placed against the surface. The magnets 270 also includes a second magnet 270*b* at the surface spaced apart from the first magnet 270*a*. As shown, the two magnets 270 are typically spaced apart from each other along the axis of the slot, and the second magnet 270*b* may be located within the length of the slot.

As shown, the sliding member 230 typically has a sliding surface 280 for mating with the holder surface 250, and the sliding member has at least two magnets 290 corresponding to those of the holder device 210. Accordingly, the sliding member 230 has a first sliding magnet 290*a* at the sliding surface 280 and a second sliding magnet 290*b* at the sliding surface spaced apart from the first sliding magnet. The distance between the first sliding magnet 290*a* and the second sliding magnet 290*b* is substantially similar to the distance between the first holder magnet 270*a* and the second holder magnet 270*b*.

When fixing the sliding member 230 to the holder device 210, the sliding member is first introduced to the system 200, as shown in FIG. 2D and is then applied to the holder device 210 in a first assembled configuration (shown in FIGS. 2C, 3A, and 4A), and is then fixed to the holder device 210 by transitioning it to a second assembled configuration (shown in FIGS. 2D, 3B, and 4B).

Similarly, when removing the sliding member 230 from the holder device 210, the sliding member is initially fixed in the second assembled configuration and is transitioned to the first assembled configuration before complete removal.

As shown, in the first assembled configuration, the sliding surface 280 is placed against the holder surface 250, and the first sliding magnet 290*a* is placed opposite the second holder magnet 270*b*. In such a way, the sliding member 230 is partially fixed to the holder device 210. This partial binding may easy complete removal of the sliding member 230, while also assisting a user in positioning the sliding member for complete insertion into the holder device 210 and a proper transition to the second assembled configuration.

In the second assembled configuration, the sliding member 230 is fully inserted into the slot and bound by the sidewalls 260. As shown, the sliding surface 280 is then flat against the holder surface 250 and the first sliding magnet 290*a* is opposite the first holder magnet 270*a* and the second sliding magnet 290*b* is opposite the second holder magnet 270*b*. When in the second assembled configuration, the first holder magnet 270*a* therefore retains the sliding member 230 at the end of its travel within the slot of the holder device 210, and the first and second holder magnets 270*a, b* combine to securely retain the sliding member in the slot. Further, the boundary formed by the sidewalls 260 further stabilizes the sliding member 230 relative to the holder device 210 by preventing rotation.

As shown, versions of the embodiment of the holder device include a clamp section 300 which can be used to fix the holder device 210 to a mobility device, such as a wheelchair. It is shown as a rounded clamp that can be tightened to size, but it will be understood that the clamp section can be modified to correspond to any anticipated fixation point on a mobility device.

Further, the sliding member 230 is typically attached to an accessory or accessory holder. As shown in the first embodiment, this may be a cup holder 140. Alternatively, the accessory holder may be a hook or retainer for a purse or a cell phone holder among others.

Figure 5A:
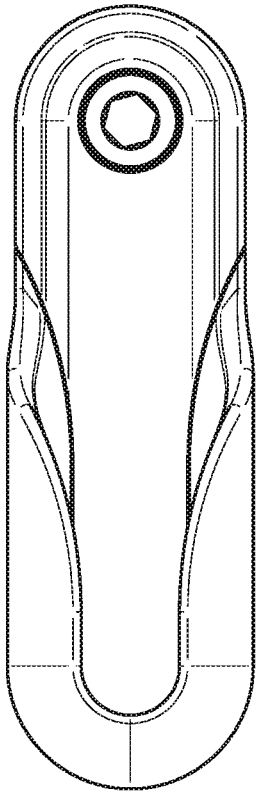
FIGS. 5A-C show a front view of the embodiment of the holder device and system of FIGS. 2A-D in three configurations in accordance with this disclosure.
Figure 5B:
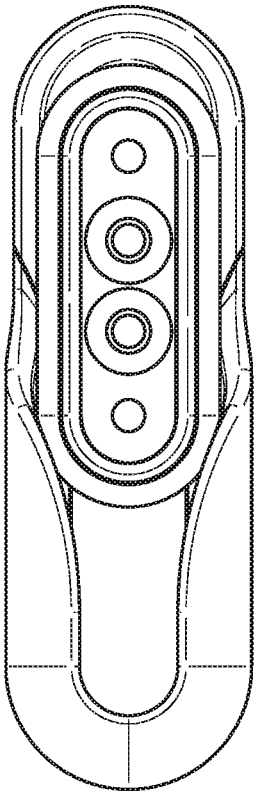
Figure 5C:
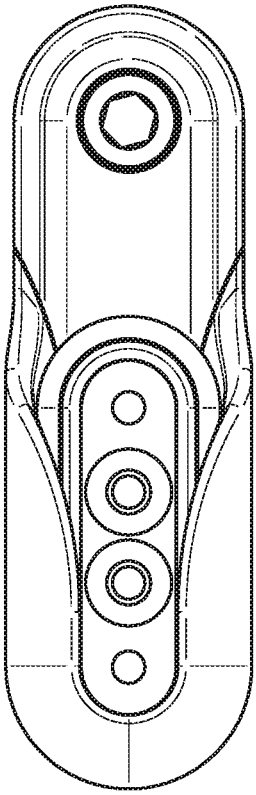

FIGS. 5A-C show a front view of the embodiment of the holder device 210 and system 200 of FIGS. 2A-D in three configurations in accordance with this disclosure.

Figure 6:
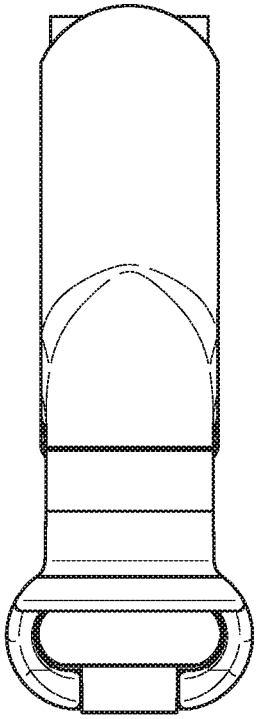
FIG. 6 shows a top view of the embodiment of the holder device and system of FIGS. 2A-D in accordance with this disclosure.

FIG. 6 shows a top view of the embodiment of the holder device 210 and system 200 of FIGS. 2A-D in accordance with this disclosure. As shown, the sidewalls 230 combined with the surface 250 of the holder device 210 form a slot that partially surrounds the sliding device 230. While a gentle arc is shown, the slot may similarly be a T shaped slot or a different shape.

Figure 7:
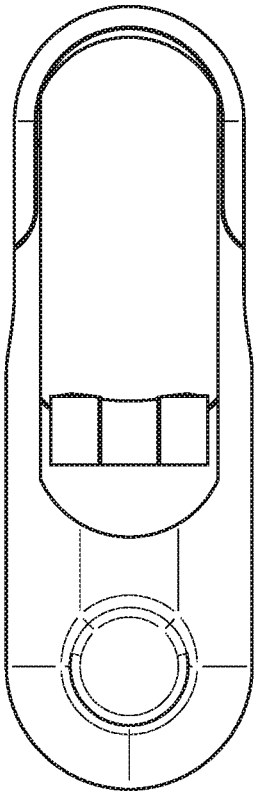
FIG. 7 shows a back view of the embodiment of the holder device and system of FIGS. 2A-D in accordance with this disclosure.

FIG. 7 shows a back view of the embodiment of the holder device 210 of FIGS. 2A-D in accordance with this disclosure.

Figure 8:
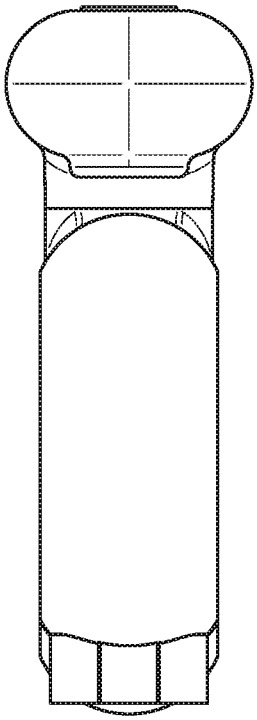
FIG. 8 shows a top view of the embodiment of the holder device and system of FIGS. 2A-D in accordance with this disclosure.

FIG. 8 shows a bottom view of the embodiment of the holder device 210 of FIGS. 2A-D in accordance with this disclosure.

Figure 9:
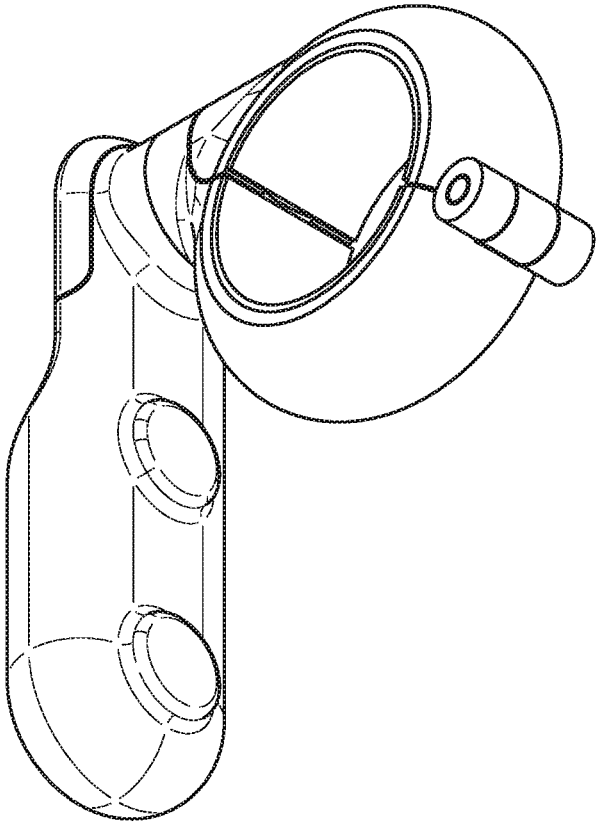
FIG. 9 shows a back perspective view of the embodiment of the holder device and system of FIGS. 2A-D in accordance with this disclosure.

FIG. 9 shows a back perspective view of the embodiment of the holder device 210 of FIGS. 2A-D in accordance with this disclosure.

Figure 10:
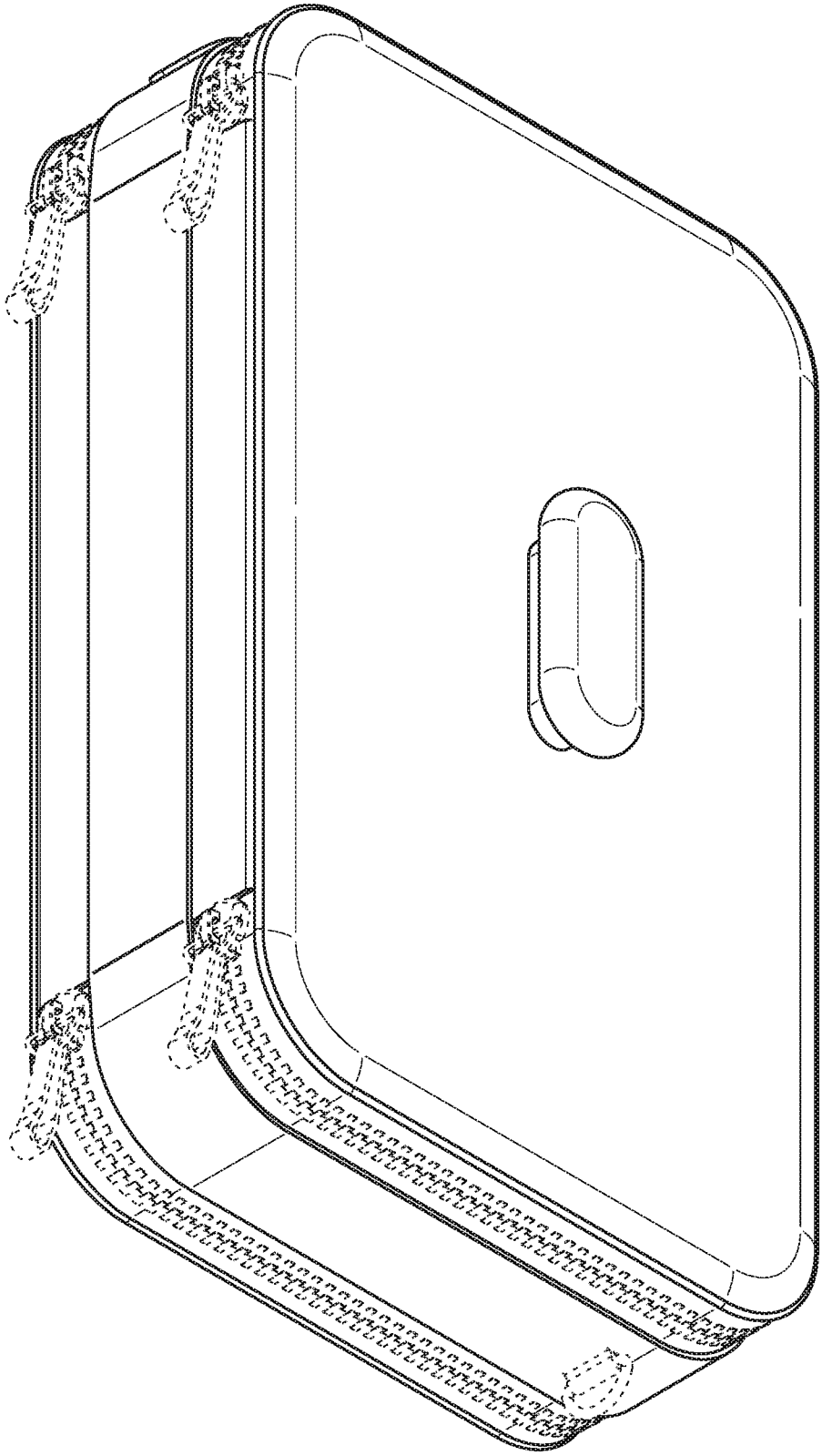
FIG. 10 shows a perspective view of the sliding member with an accessory attached thereto.
Figure 11:
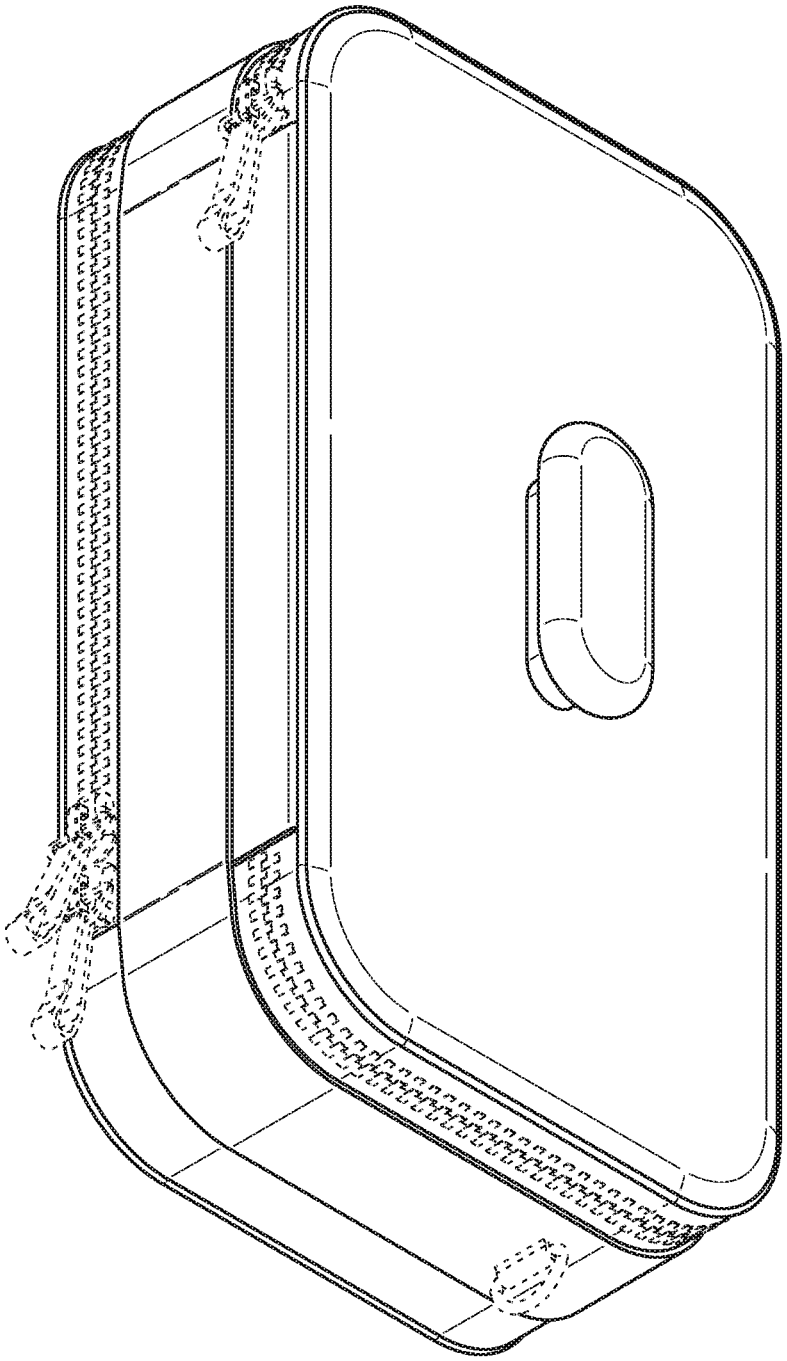
FIG. 11 shows a perspective view of the sliding member with an accessory attached thereto.

FIGS. 10 and 11 show perspective views of the sliding member 230 with an accessory attached thereto. As shown, the accessory may be a bag, such as a purse. Alternatively, the accessory may be a cup holder 140 as shown in FIGS. 1A-1B.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A holder device for attachment to a wheelchair or other mobility equipment, the device comprising:
- a surface at least partially bounded, the bounded portion defining a slot having an elongated opening opposite the surface;
- a first holder magnet at the surface adjacent a terminus of the slot; and
- a second holder magnet at the surface spaced apart from the first magnet.

2. The holder device of claim 1, wherein the surface is only partially bounded, and wherein the first holder magnet is in the slot and the second holder magnet is outside the slot.

3. The holder device of claim 1, wherein both the first and second holder magnets are within the bounded portion of the holder device surface.

4. A system for fixing an accessory to mobility equipment comprising:
- a holder device for attachment to a wheelchair or other mobility equipment, the device comprising:
  - a holder surface at least partially bounded, the bounded portion defining a slot
  - a first holder magnet at the surface adjacent a terminus of the slot;
  - a second holder magnet at the surface spaced apart from the first holder magnet; and
- a sliding member for interfacing with the holder device, the sliding member comprising:
  - a sliding surface for mating with the holder surface;
  - a first sliding magnet at the sliding surface of the sliding member; and
  - a second sliding magnet spaced apart from the first sliding magnet,
  - wherein a distance between the first sliding magnet and the second sliding magnet is substantially similar to a distance between the first holder magnet and the second holder magnet.

5. The system of claim 4, wherein when the sliding member is fully inserted into the slot, the first holder magnet is opposite the first sliding magnet and the second holder magnet is opposite the second sliding magnet.

6. The system of claim 4, wherein the holder surface is only partially bounded, and wherein the first holder magnet is in the slot and the second holder magnet is outside the slot, and wherein:

in a first assembled configuration, the first sliding magnet is opposite the second holding magnet; and in a second assembled configuration, the sliding member is fully inserted into the slot, the first holder magnet is opposite the first sliding magnet and the second holder magnet is opposite the second sliding magnet.

7. The system of claim 6, wherein the first assembled configuration initially retains the sliding member when inserting the sliding member into the holder and finally retains the sliding member when removing the sliding member from the holder, and wherein the first assembled configuration is a transitional configuration between the second assembled configuration and fully detaching the sliding member from the holding member.

8. The system of claim 6, wherein in the second assembled configuration, the first holder magnet retains the sliding member at the end of its travel within the slot, and wherein the first and second holder magnets combine to securely retain the sliding member in the slot, and wherein the boundary of the slot prevents rotation of the sliding member relative to the holder device.

9. The system of claim 4, wherein the holder surface is only partially bounded, and wherein the first holder magnet is in the slot and the second holder magnet is outside the slot.

10. The system of claim 4, wherein both the first and second holder magnets are within the bounded portion of the holder device surface.

11. The system of claim 4 further comprising an accessory holder fixed to the sliding member.

12. The system of claim 11, wherein the accessory holder is a cup holder.

13. The system of claim 4 further comprising an accessory fixed to the sliding member.

14. The system of claim 13, wherein the accessory is a purse.

* * * * *